US007831177B2

(12) United States Patent
Someya et al.

(10) Patent No.: US 7,831,177 B2
(45) Date of Patent: Nov. 9, 2010

(54) DISCHARGE DEVICE, IMAGE FORMING UNIT AND APPARATUS

(75) Inventors: Yukimichi Someya, Machida (JP); Naomi Sugimoto, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 870 days.

(21) Appl. No.: 11/494,526

(22) Filed: Jul. 28, 2006

(65) Prior Publication Data

US 2007/0025769 A1 Feb. 1, 2007

(30) Foreign Application Priority Data

Jul. 28, 2005 (JP) ..... 2005-218918

(51) Int. Cl.
*G03G 15/02* (2006.01)

(52) U.S. Cl. ..... 399/168; 399/50; 399/176

(58) Field of Classification Search ..... 399/38, 399/46, 48, 50, 115, 168, 174, 176, 82, 85, 399/138

See application file for complete search history.

(56) References Cited

U.S. PATENT DOCUMENTS

| | | | | |
|---|---|---|---|---|
| 5,585,896 | A | 12/1996 | Yamazaki et al. | |
| 5,749,022 | A | 5/1998 | Kikui et al. | |
| 5,845,177 | A * | 12/1998 | Choi | 399/115 |
| 6,721,523 | B2 * | 4/2004 | Sugiura et al. | 399/176 |
| 6,803,162 | B2 * | 10/2004 | Niimi | 430/56 |
| 2005/0175374 | A1 * | 8/2005 | Kosuge | 399/168 |

FOREIGN PATENT DOCUMENTS

| | | |
|---|---|---|
| JP | 60-252376 | 12/1985 |
| JP | 07-092749 | 4/1995 |
| JP | 07-301973 | 11/1995 |
| JP | 08-314236 | 11/1996 |
| JP | 2002-055508 | 2/2002 |
| JP | 2002-229307 | 8/2002 |
| JP | 2004-309939 | 11/2004 |
| JP | 2005-092117 | 4/2005 |

OTHER PUBLICATIONS

U.S. Appl. No. 12/186,906, filed Aug. 6, 2008, Someya, et al.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

A discharge device including a discharge member that discharges an photoconductive member overlying an image bearer via a prescribed gap, and a voltage applying device that only applies direct current voltage to the discharge member. The below described relation is established, wherein AV is a difference in voltage on the photoconductive member creating an imperceptible difference in density on an output image, d (V/micrometer) is a rate of a voltage discharged on the photoconductive member in relation to an interval of the gap I (micrometer) between the discharge member and the image bearer:

$$\Delta V \geqq I \cdot d.$$

11 Claims, 6 Drawing Sheets

DISCHARGE DEVICE, IMAGE FORMING UNIT AND APPARATUS

CROSS REFERENCE TO RELATED APPLICATION

This application claims priority under 35 USC §119 to Japanese Patent Application No. 2005-218918, filed on Jul. 28, 2005, the entire contents of which are herein incorporated by reference.

BACKGROUND OF THE INVENTION

1. Field of the Invention

The present invention relates to a discharge device, an image formation unit, and an image forming apparatus, such as a copier, a fax, a printer, etc., employed in the discharge device.

2. Discussion of the Background Arts;

In the image forming apparatus, such as an electrophotograph apparatus, an electrostatic recording apparatus, etc., a surface of a latent image carrier, such as a photoconductive member, a dielectrics, etc., is discharged to form a latent image. As a discharge device, a scorotron system, which applies high voltage to a tungsten wire and creates and executes corona discharge or a corotron system is employed. However, such a system needs a large power and creates a problem in that a significant amount of ozone or oxides of nitrogen (NOx) is output into atmosphere due to corona discharge created by the high voltage application.

In these years, various contact type discharge devices have been proposed such that a discharge member contacts an image bearer without executing corona discharge as discussed in Japanese Patent Application Laid Open No. 63-7380. Since a low voltage is applied to a discharge roller in this discharge system, an amount of ozone is advantageously small extraordinarily. Thus, such a system is increasingly employed in a copier and a printer, recently. This contact typed is charge device also resolves many other problems caused by the above-mentioned discharge device executing corona discharge.

Such a contact type roller discharge system uses a rubber or plastic discharge roller to stably contact a photoconductive member. However, the photoconductive member is polluted due to emergence of low-molecular component included in the rubber or plastic as a problem. Also created as a problem is traversal lines appearing at a pitch of the photoconductive member or the a discharge roller. Further, since the discharge roller contact the photoconductive member, toner or paper dust and equivalent remaining on the photoconductive member sticks and pollutes the discharge roller. Further, an abnormal image, such as a ghost image, etc., is created, and an amount of abrasion of an image bearer increases.

Then, it has been recently proposed that a small gap is created between a discharge member and an image bearer to suppress a problem of quick deterioration of the surface of the image bearer as discussed in Japanese Patent Application Laid Open No. 2002-55508.

Further, in order to resolve a problem, in which a discharge voltage changes and accordingly an abnormal image is created when a gap length changes, and stably execute discharge, a fine unevenness is formed on a surface of a discharge device as discussed in Japanese Patent Application Laid Open No. 7-287433. Specifically, uniform discharge is executed while avoiding creation of the abnormal image even though the gap length changes. However, since such a fine unevenness varies as time elapses or sometime disappears, when exposed to a severe condition, such as discharge, etc. When such unevenness disappears, an originally intended goal can't be reached, and accordingly, a uniform discharge can be hardly executed for a long term. Further, since fine unevenness is limited to a prescribed range, a production process becomes difficult and costly.

Further, as a discharge bias applying system, a DC voltage applying system, and a DC/AC super imposed voltage applying system (hereinafter referred to as a superimposed DC+AC system) are exemplified. The DC voltage apply system is hardly used practically due to unevenness of discharge voltage caused by gap length variation and a problem of instability of discharge. It is known that the DC/AC superimposed voltage applying system is more preferable than the DC voltage apply system as to stability of discharge voltage during gap length variation. Thus, the DC/AC superimposed voltage applying system is believed to be suitable system for non-contact type discharging.

It is also known that an AC voltage applying system largely receives damage on a photoconductive member. Further, discharge generates a large number of discharge products in a discharge section as many as corona charge. That is, the DC/AC superimposed type discharges an enormous number of times more than the DC discharge system. Further, the DC/AC superimposed type creates a problem of noises when alternate current is used for an application voltage.

In the DC voltage applying system, it has been proposed that a plurality of members is provided to contact a photoconductive member to suppress variation and stabilize the gap. However, there is a limit to suppression of a size error when a discharge roller and a photoconductive member are manufactured. In addition, parts cost increases.

As mentioned above, a difference in a discharge voltage takes place due to variation in length of a gap between a discharge roller and a photoconductive member when the non-contact type DC discharge system is employed. When the voltage difference causes a difference in toner adhesion amount when an image is visualized in a developing process, unevenness takes place in an image. Further, gap length unevenness periodically occurs due to eccentricity of the discharge roller or the photoconductive member, thereby causing image unevenness. To suppress such eccentricity, a size precision is strictly demanded in a discharge roller or a photoconductive member, thereby increasing a parts cost.

SUMMARY OF THE INVENTION

The present invention has been made in view of the above noted and another problems and one object of the present invention is to provide a new and noble discharge device that includes a discharge member that discharges an photoconductive member overlying an image bearer via a prescribed gap, and a voltage applying device that only applies direct current voltage to the discharge member. The discharge device establishes the below described relation, wherein $\Delta V$ is a difference in voltage on the photoconductive member creating an imperceptible difference in density on an output image, d (V/micrometer) is a rate of a voltage discharged on the photoconductive member in relation to an interval of the gap I (micrometer) between the discharge member and the image bearer;

$$\Delta V \geqq I \cdot d.$$

In another embodiment, an image forming unit is detachably attached to an image forming apparatus and includes the discharge device and a writing device that writes an image on the photoconductive member while forming a latent image on the photoconductive member by meeting the above-mentioned relation.

In yet another embodiment, the image is created using a digital signal, and the difference in density on the output image adjusts a resolution.

In yet another embodiment, the image forming unit includes a controller configured to change a resolution of a latent image. A distance between the discharge member and the image bearer is changed in accordance with the resolution.

In yet another embodiment, quality of an image is changed by changing a distance between the discharge member and the image bearer.

In yet another embodiment, the discharge device and the image bearer are integrated.

In yet another embodiment, the image formation unit includes a contact type cleaning member contacting the surface of the image bearer that cleans the surface. The contact type cleaning member and the discharge device are integrally detached from the image forming apparatus.

In yet another embodiment, quality of an output image is adjusted by changing a distance between the discharge member and the image bearer.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
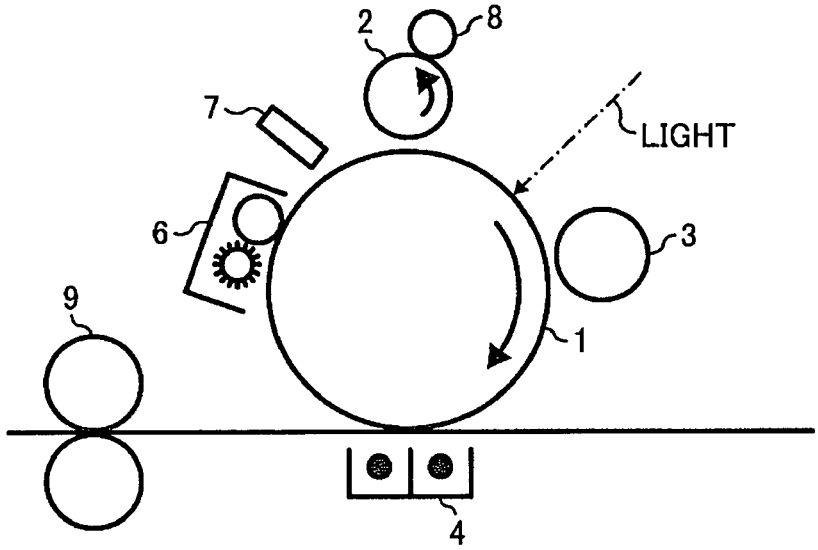
FIG. 1 illustrates an exemplary image forming apparatus employing a discharge device according to one embodiment of the present invention.

Referring now to the drawings, wherein like reference numerals and marks designate identical or corresponding parts throughout several figures, in particular in FIG. 1, an image formation section and its surroundings included in an image forming apparatus is illustrated together with a discharge device according to one embodiment. As shown, a discharge roller 2, a developing device 3, a transfer device 4, a cleaning unit 6, and a charge removing lamp and so on are arranged around a photoconductive drum 1. A cleaning brush roller 8 is attached to the discharge roller 2. Numeral number 9 denotes a fixing apparatus. Even though the cleaning unit 6 employs the cleaning brush roller, a blade type can be employed.

Figure 2:
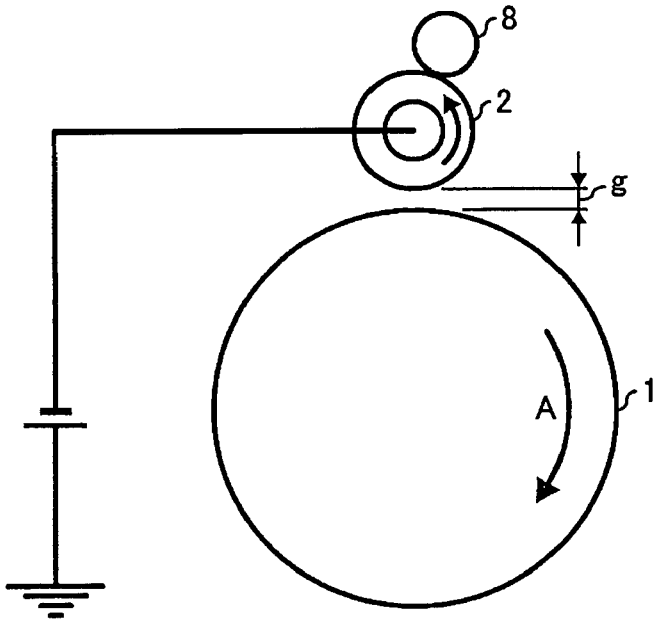
FIG. 2 illustrates exemplary surroundings of a discharge roller according to one embodiment of the present invention.

As shown in FIG. 2, the discharge roller 2 opposes a photoconductive drum 1 via a very little gap. The discharge roller 2 is applied a discharge bias of a direct current voltage, such as −1.5 kV, for example. Generally, the discharge roller 2 is reversely rotated (e.g. counter clockwise) by a driving mechanism, such as a gear, etc., not shown, to the photoconductive drum 1 rotating clockwise in the drawing. However, the discharge roller 2 can rotate in the same direction as the photoconductive drum 1. Even though the gear is included, every type of a driving mechanism can be intervened. Either of members can be driven by the other. Further, a rotational speed of the discharge roller 2 is preferably the same to a line speed of the photoconductive drum 1 in consideration of abrasion of the photoconductive member. However, the speed can be lower. Attention should be paid when the speed is higher, because discharging becomes unstable due to gap length variation caused by vibration of the discharge roller. A cleaning blade 8 is attached to the discharge roller 2 so as to remove stein of a toner and equivalents adhered to the discharge roller 2. Since an amount of such stein varies in accordance with a gap length, the cleaning blade 8 can be omitted in a certain circumstance.

Figure 3:
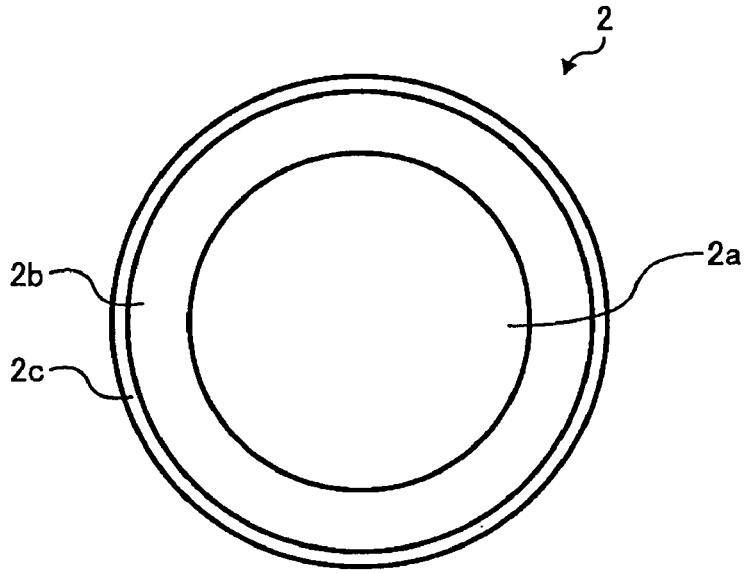
FIG. 3 illustrates an exemplary discharge roller according to one embodiment of the present invention.

As shown in FIG. 3, a discharge device includes a discharge member opposing a surface of an image bearer (e.g. a photoconductive member). The discharge member can be appropriately shaped to be a discharge roller.

Such a discharge member includes a conductive core metal 2*a* in a cylindrical column state, a cylindrical middle resistance layer 2*b* secured to the core metal 2*a*, and a surface layer 2*c* overlying an outer circumference surface of the discharge roller. The core metal 2*a* with a diameter of from about 4 to 20 mm includes stainless steel or aluminum having high rigidity and conductivity. Otherwise, a conductive resin of high rigidity having a cubic resistance (rate) less than $1\times10^3$ ohm·cm, preferably $1\times10^2$ Ω·cm can be employed. The core metal 2*a* serves as a core axis of the discharge roller 2. The cubic resistance (rate) of the middle resistance layer 2*b* having a thickness of 1 to 2 mm is about $10^4$ to $10^9$ ohm·cm. The cubic resistance (rate) of the surface layer 2*c* is from about $10^6$ to about $10^{11}$ ohm·cm, and is preferably a little bit higher than that of the middle resistance layer 2*b*. The thickness of the surface layer 2*c* is about 10 micrometer, for example.

Figure 4:
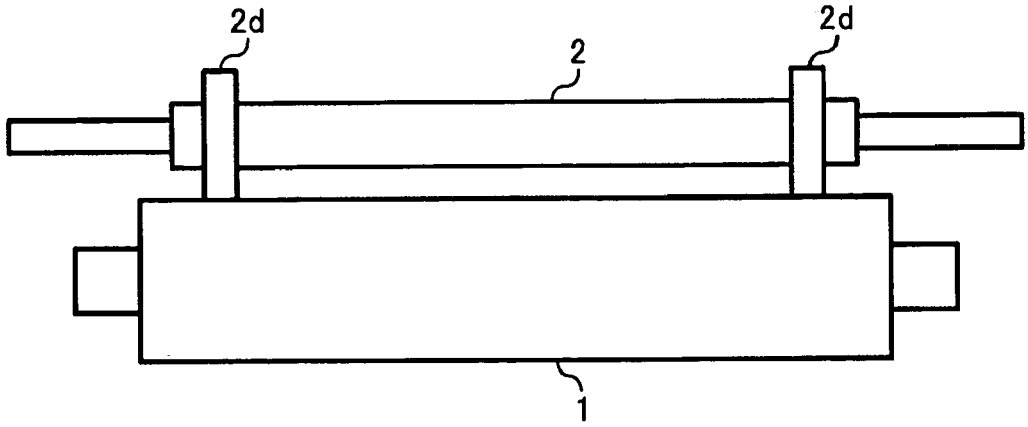
FIG. 4 illustrates an exemplary gap formed between a discharge roller and a photoconductive member according to one embodiment of the present invention.

Formation of a gap between a discharge roller 2 and a photoconductive member drum 1 is now described with reference to FIG. 4. As shown, a very little gap is formed by winding a pair of tape state spacer members 2*d* in the vicinity of both ends in its axial direction around the discharge roller 2. However, prescribed rollers and equivalents can be provided to form a gap.

Now, material of each of portions of the discharge roller 2 is specifically exemplified. As material of a tape forming the spacer 2*d*, organic or inorganic material, such as metal (e.g. aluminum, iron, nickel), metal oxide, etc., is exemplified. Also exemplified as organic or inorganic material are metal alloy; such as Fe—Ni alloy, stainless steel, Co—Al alloy, Ni steel, drumlin, monel, inconel, etc., olefin resin; such as PE, PP, etc., polyester resin; such as PET, PBT, etc., fluoroethylene resin; such as PTFE, copolymer (e.g. PFA, FEP), etc., polyamide-imide resin, and polyimide resin. In particular, material having high mold releasability hardly adhered by toner is preferably used. Further, when conductive material is used for the tape, an image bearer is insulated from the tape by coating an insulating layer or half resistant layer on the surface of the tape.

The middle resistance layer 2*b* is formed from a base member, in which conductive agent is dispersed. As the base member, olefin resin; such as polyethylene (PE), polypropylene (PP), etc., styrene resin; such as (PS), copolymer (e.g. AS, ABS), etc., acrylic resin; such as polymethacrylic aid methyl (PMMA), etc., having an excellent processing performance are employed.

As conductive agent for the middle resistance layer 2*b*, metal salt such as hyperoxidation lithium, perchloric acid salt such as natrium, fourth degree ammonium salt such as tetra butyl ammonium salt, ion conductive agent such as macromolecule conductive agent or the like can be used. Further, carbon black, such as ketjen black, acetylene black, etc., can be used.

The surface layer 2*c* can include a base member with dispersion of conductive agent. As the base material, Fluorocarbon resin, silicone resin, acrylic resin, polyamide resin, polyether resin, polyvinyl butyric resin, polyurethane resin, and equivalents are used. In particular, material hardly contacted by toner is preferably selected. As conductive material of the surface layer 2*c*, electronically conductive agent including carbon black; such as ketjen black, acetylene black, etc., metal oxide; such as oxidized indium, oxidized tin, etc., and other appropriate conductive agent can be used. However, the discharge roller 2 is not limited to the above-mentioned material.

The first example is now described.

A relation between a gap length and a discharge voltage is investigated using a copier manufactured by Ricoh Co, Ltd., (Model name: CX9000) on condition that a line speed of an image bearer is 185 mm/sec. A direct current voltage is applied to a discharge roller while a gap length is changed by using a gap control member arranged at both ends of the discharge roller. A relation between the gap length and a voltage on a photoconductive member is then investigated.

Figure 5:
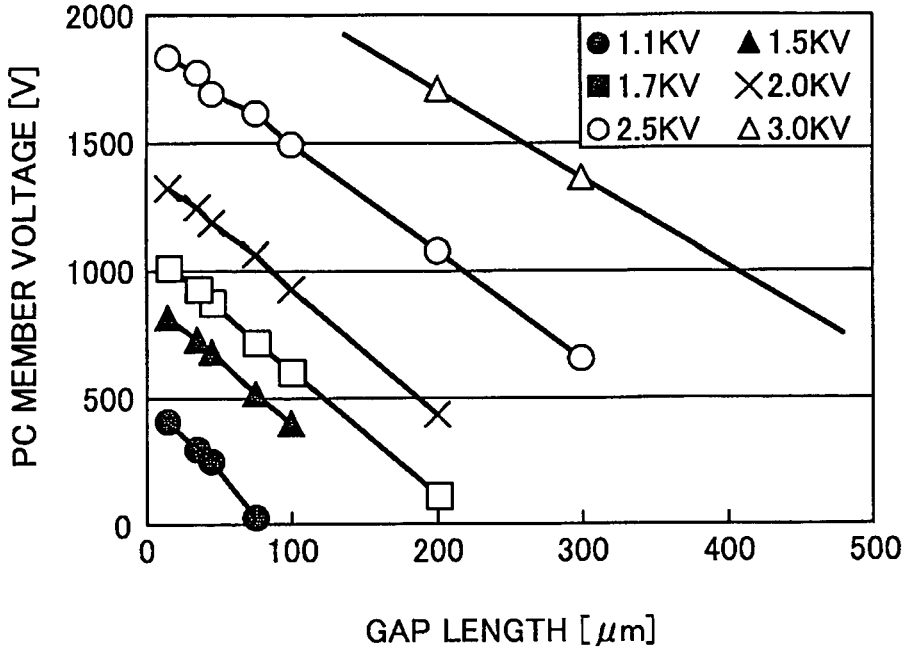
FIG. 5 illustrates an exemplary relation between an applied voltage and a discharge voltage on the photoconductive member according to one embodiment of the present invention.

Now, a relation between an applied voltage, a discharge voltage on a photoconductive member, and a gap length is described with reference to FIG. 5. As shown, as an application voltage increases, an inclination, which represents a variation in discharge voltage on a photoconductive member in relation a gap length, decreases. Such a value (i.e., inclination) is defined as a gap dependence (rate) "d". Further, a higher voltage is needed when the gap is wider in order to obtain a prescribed discharge voltage on the photoconductive member.

A relation between a gap creating a prescribed voltage on the photoconductive member and the gap dependency (rate) is described with reference to FIG. 6. Specifically, a relation between a gap creating a voltage on a photoconductive member of 700 v and a gap dependency (rate) is described. As noted therefrom, the larger the gap length, the smaller the variation in voltage on the photoconductive member in relation to the gap length.

Figure 7:
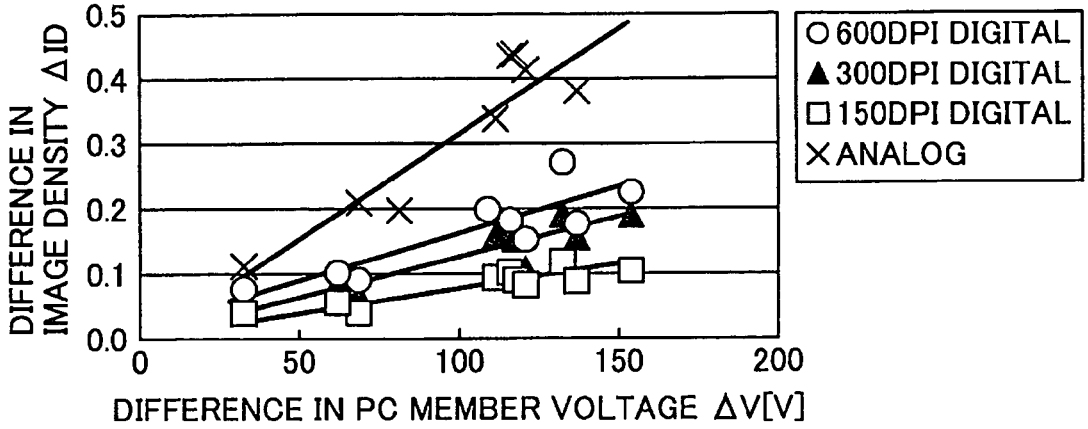
FIG. 7 illustrates an exemplary relation between a difference in image density and that in a voltage on a photoconductive member according to one embodiment of the present invention.

Now, a relation between a difference in density within an image and a voltage on a photoconductive member during a printing process of the above-mentioned apparatus is described with reference to FIG. 7. An image outputted by a digital system using a different resolution from an analog system is evaluated. In each of lines, image density is about 0.3 when measured by X-Rite938 manufactured by X-Rite Co, Ltd.

Since it was found as a result that a difference is not perceptually sensed when it is less than 0.1, an allowable difference in voltage on a photoconductive member corresponds to the allowable difference in image density of less than 0.1. Further, it is understood from FIG. 7 that a digital image has a larger difference in voltage on the photoconductive member capable of allowing a difference in density than an analog image. This means that density change is smaller in a case of a digital image than in a case of the analog image, if variation in charge voltage on the photoconductive member caused due to variation in gap length is the same in these cases. It is further noted that impact of a voltage difference on an image density difference varies in accordance with resolution even in the digital system. Specifically, the smaller the resolution, the larger the allowable voltage difference. This is a performance of a digital system in which a latent image is formed by a laser beam with dots. That is, a size of the dot formed there is inverse proportion to a level of resolution, and the dot with smaller resolution formed by the digital system is hardly impacted due to its large size.

For example, an allowable difference $\Delta V$ in voltage on the photoconductive member is about 30V to satisfy an allowable difference in density in an analog system, for example. When the allowable difference $\Delta V$ is divided by the above-mentioned gap dependence (rate) "d", a gap length variation allowing the difference in density of 0.1 can be calculated. Further, a gap length variation "I" is generally 100 micrometer when a discharge roller is manufactured with typical size precision. When such a gap length variation of 100 micrometer is supposed to be the limit, the below described formula is obtained:

Allowable difference in voltage on a photoconductive member (30V/100 micrometer)=Gap dependence (rate) 0.3V/micrometer. Thus, when a gap length variation is 100 micrometer, a gap dependence (rate) "d" needs 0.3V/micrometer. When size precision is improved to have a gap length variation of 50 micrometer, a gap dependence (rate) "d" becomes 0.6V/micrometer, thereby a gap margin increases.

In the digital system, the below described relations are established in accordance with dpi.

Figure 6:
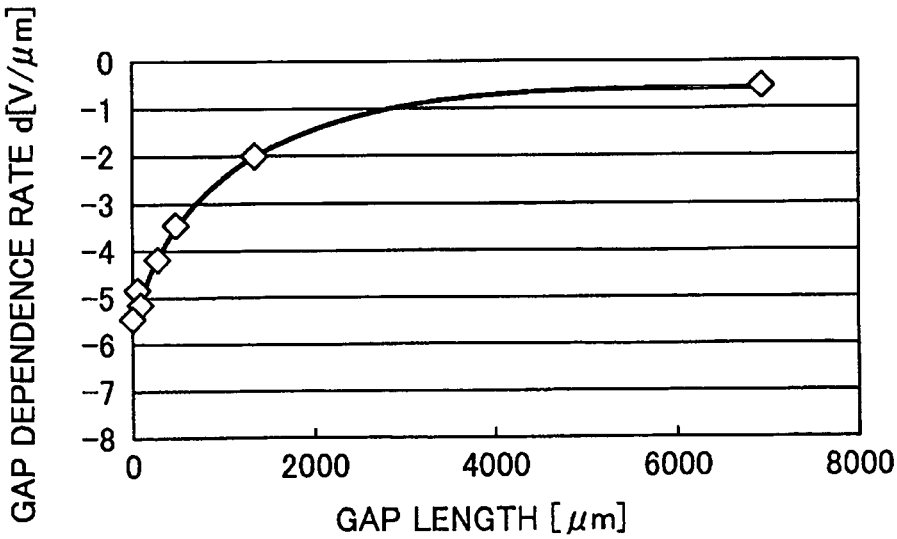
FIG. 6 illustrates an exemplary rate of dependence to a gap of a voltage on a photoconductive member according to one embodiment of the present invention.

600 dpi:

60V/100 micrometer=Gap dependence (rate): 0.6V/micrometer, corresponding gap length: about 4 mm 300 dpi:

80V/100 micrometer=Gap dependence (rate): 0.8V/micrometer, corresponding gap length: about 3 mm 150 dpi:

120V/100 micrometer=Gap dependence (rate): 1.2V/micrometer, corresponding gap length: about 2.2 mm Thus, if an amount of application voltage in each of the image formation systems is determined to create a prescribed amount of voltage on a photoconductive member with a gap length corresponding to a gap dependence (rate) "d" as shown in FIG. 6, an image satisfying an allowable difference in density can be obtained.

Specifically, when the gap dependence (rate) "d" is minimized by increasing the gap length in a high resolution image forming apparatus or method, unevenness of density caused by variation of a gap length can be suppressed. In contrast, the gap dependence (rate) "d" is not necessarily minimized in a low resolution image forming apparatus or method. Thus, minimization of the variation in gap length caused by parts precision is omitted. Specifically, it is needed neither to increase in gap length nor to improve parts precision.

Thus, by adjusting the gap length to satisfy the below described relation, an image can be formed with allowable variation in discharge voltage on a photoconductive member caused by variation in gap length, which satisfies a prescribed difference in density, wherein ΔV is a difference in voltage on a photoconductive member creating a prescribed allowable difference in density on an output image, d (V/micrometer) is the gap dependence (rate), and I (micrometer) is a variation in length of a gap between a discharge member and an image bearer;

$$\Delta V \geqq I \cdot d.$$

Even though the above-mentioned embodiment employs a discharge roller, similar effect can apparently be obtained when another type of a discharge device such as a blade system, etc., is employed.

Figure 8:
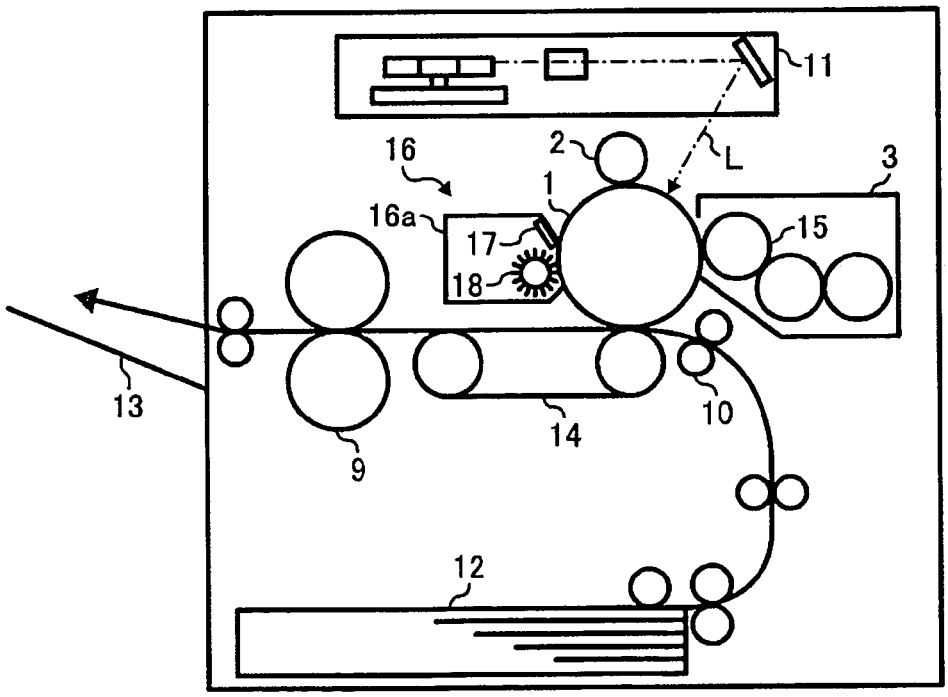
FIG. 8 illustrates an exemplary entire image forming apparatus according to one embodiment of the present invention.

The entire image forming apparatus according to the present invention is now described with reference to FIG. 8. As shown, an image formation unit almost similar to that described with reference to FIG. 1 is arranged almost in a middle section of the app body. A difference from that in FIG. 1 is a conveyance belt unit 14 employed instead of the transfer charger 4 and the separation charger 5. The same numbers are assigned to the same configurations or functions to those in FIG. 1. The cleaning blade 8 and the charge removing lamp 7 attached to the discharge roller 2 are omitted.

A laser write unit 11 is arranged in the upper side of the apparatus as one example of an exposure device. A cassette 12 is arranged in the lower side of the apparatus as a sheet feeding device. A registration roller 10 is arranged below a photoconductive member drum 1. Further, a sheet ejection tray 13 is arranged on the left outer side of the apparatus as shown in FIG. 8.

In the image forming apparatus, a discharge bias of a direct current voltage is applied to the discharge roller 2 as in the embodiment of FIG. 1. Further, an image bearer is arranged in the apparatus body. The image bearer is formed from a photoconductive member 1 having a cylindrical conductive base and a photoconductive layer arranged over the peripheral surface of the conductive base. The image bearer can be an endless belt wound and driven around a plurality of rollers.

The photoconductive member drum 1 is driven clockwise during image formation, and is discharged by the discharge device 2 in a prescribed polarity. The photoconductive member drum 1 then receives a laser light "L" emitted and modulated from a laser write unit 11, thereby forming a latent image thereon. A portion receiving the laser light on the surface of the image bearer decreases an absolute voltage, thereby forms a latent image of an image portion. In contrast, a portion not receiving the laser light on the surface of the image bearer maintains an absolute voltage, and there by forms a background image. Then, the latent image is visualized into a toner image by toner discharged in a prescribed polarity during passing through a developing device 3. An exposure device having an LED array or an analog type emits a beam to a surface of an original document and image the original document on the image bearer.

On the other hand, the sheet cassette 12 launches a transfer sheet of a recording medium. The registration roller 10 feeds the transfer sheet toward a transfer station, where the photoconductive member drum 1 and a transfer conveyance belt unit 14 oppose each other, at a prescribed time. A toner image formed on the photoconductive member drum 1 is electrostatically transferred onto the transfer sheet. That sheet is conveyed to a fixing apparatus 9 by the transfer conveyance belt 14. The fixing apparatus 9 fixes the toner image onto the transfer sheet by applying heat and pressure. The transfer sheet is then ejected onto the sheet ejection tray 13. A cleaning device 6 removes post transfer toner remaining on the photoconductive member surface.

The developing device 3 stores dry type developer such as toner in a developing casing. A developing roller 15 serves as a developing member carrying and conveying the developer. As the developer, two-component developer including toner and carrier, or one component developer excluding carrier can be employed. Also, liquid type developer can be employed.

The developing roller 15 is rotated counter clockwise, while carrying and conveying the developer on the surface. The toner of the developer in the development station between the developing roller 15 and the photoconductive member drum 1 electrostatically moves to the latent image, thereby visualizing the latent image into a toner image.

The transfer conveyance belt unit 14 includes a transfer roller applied a transfer voltage having a polarity opposite to a discharge voltage of the toner carried on the photoconductive member drum 1. Beside the transfer roller, another transfer device including a transfer brush, a transfer blade or a corona discharge roller having a corona wire can be employed. Further, instead of directly transferring the toner image carried on the photoconductive member drum 1 onto a transfer sheet as an ultimate recording medium, the toner image can be transferred onto the ultimate recording medium via an intermediate transfer member.

The cleaning unit 16 includes a cleaning blade 17 supported by a cleaning case **16*a* at its basic end, and a cleaning member having a fur brush 18 freely rotatably supported by the cleaning case 16*a*. The cleaning member cleans the post transfer toner remaining on the surface of the photoconductive member drum 1** by contacting the surface. Another cleaning device having appropriate shape other than the cleaning device can be employed.

In FIG. 1, an image forming apparatus includes a cleaning device 6 that removes post transfer toner adhering to a surface of an image bearer after toner image is transferred. The cleaning device can be omitted, and a developing device can remove post transfer toner.

Further, in the image forming apparatus, a unit casing, not shown, can be formed to freely rotationally support a discharge roller 2, and a cleaning casing of a cleaning unit, as well as a photoconductive member drum 1. Further, the unit casing is detachably attached to the image forming apparatus body.

The discharge roller 2 and the photoconductive member drum 1 are installed in the unit casing with a constant small gap therebetween to be detachably attached to the image forming apparatus body maintaining the gap length. Thus, when the image formation unit is attached or detached, the gap does not largely change. The photoconductive member 1 and the discharge roller 2 can be detachably attached to the image forming apparatus body, separately. However, such a configuration possibly largely changes the gap, and creates uneven discharge.

Further, the image formation unit of FIG. 1 includes a contact member that contacts the photoconductive member drum 1 beside the discharge roller 2. Back to FIG. 8, the cleaning blade 17 and the fur brush 18 are installed in the cleaning case **16*a*, and constitute the contact members contacting the image bearer. The cleaning case 16*a* is formed as an integral unit casing including a casing (not shown) that supports the discharge roller 2. Accordingly, when the image formation unit is detached or attached, the contacting members contacting the photoconductive member drum 1, such as the cleaning blade 17, the fur brush 18**, etc., is detached or attached integrally.

However, such contact members can be designed to be separately detached or attached from and to the image forming apparatus body from the discharge roller 2. With this configuration, since these members move while contacting (sometimes, depressing) the image bearer during detachment or attachment, a large force is externally applied to the image bearer.

As a result, a gap between the discharge roller 2 and the photoconductive member drum 1 likely varies. In contrast, when the contact members are made into components of the image formation unit, i.e., included as members integrally detached or attached, such contact members are detached or attached together while avoiding relative displacement to the image bearer. As a result, the above-mentioned gap does not largely change.

As mentioned above, the image forming apparatus of FIG. 8 includes the discharge roller 2 and the photoconductive member drum 1 while variation in length of a gap therebetween is suppressed. To further suppress such variation, the photoconductive member 1 is preferably includes am amorphous silicone surface layer. Since such an image bearer has excellent hardness, the surface of the image bearer can be readily smoothly finished, and variation in the gap length can be effectively suppressed when the image bearer is rotated. Further, advantages obtained by the above-mentioned embodiment can be more ensured. Due to excellent hardness, size of parts can be more precise. Due to succeeding in suppressing variation in gap length can be minimized, and accordingly, voltage to be applied to the discharge member can be minimized.

An image bearer can be constituted by a photoconductive member having a surface layer of less than 0.1 micrometer including dispersion of filler such as aluminum powder, etc. In such a situation, since surface hardness of the image bearer is increased, size of parts becomes more precise. Since variation in gap length is suppressed, a length of a gap is substantially decreased, and accordingly, voltage to be applied to the discharge member can be minimized. Further, less amount of ozone is output. Since abrasion resistance is improved while suppressing breakage of the surface of the image bearer is decreased in a DC discharge system, a life of the image bearer can significantly be prolonged.

Figure 9:
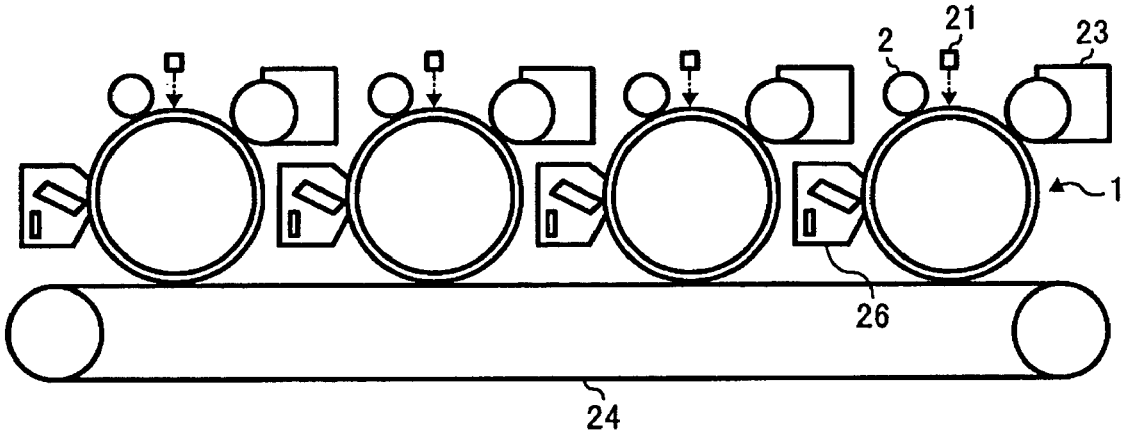
FIG. 9 illustrates an exemplary color image forming apparatus employing a discharge device according to one embodiment of the present invention.

The second example is now described. Heretofore, an image forming apparatus not using pigment toner is described. However, the same effect can be obtained in a color image forming apparatus including an image formation system having a plurality (e.g. four) of photoconductive member drums 1 as shown in FIG. 9 when the same configuration of the photoconductive member and the discharge roller are employed.

Figure 10:
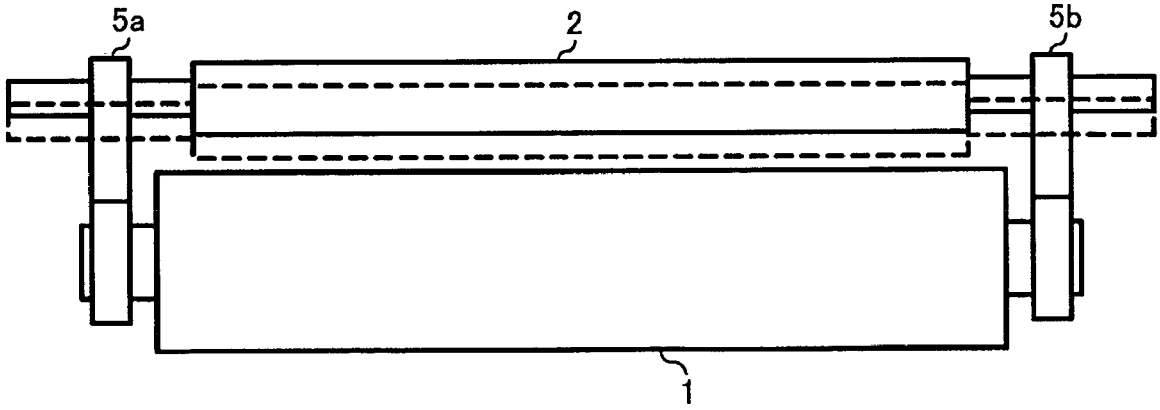
FIG. 10 is an exemplary mechanism for changing a gap according to one embodiment of the present invention.

A configuration, in which a discharge roller and a photoconductive member are attached so that a length of a gap can be changed, is now described with reference to FIG. 10. A pair of cum shape spacers 5*a* and 5*b* are employed. Both ends of the discharge roller 2 is rotatably attached to the spacers 5*a* and 5*b* at prescribed positions so that a distance from a core metal center to a sliding surface of the spacer 5*a* or 5*b* can change. A core metal of the photoconductive member 1 is freely rotatably attached to a pair of bearings 33 at its both ends. The spacers 5*a* and 5*b* and the bearings 33 contact each other at the both ends.

Figure 11:
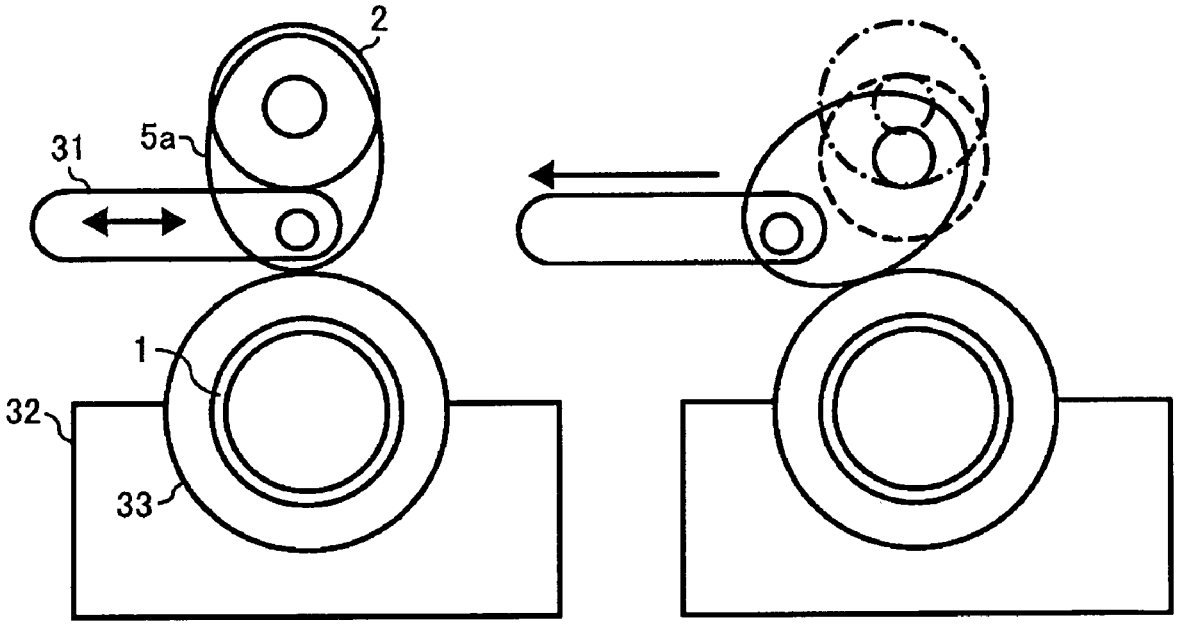
FIG. 11 illustrates an exemplary cross section of the mechanism of FIG. 10.

As shown in FIG. 11, the bearing 33 supporting the photoconductive member 1 is embedded into a supporting plate 32. A driving shaft 31 is freely rotatably attached to a position other than where the spacer 5*a* supports the discharge roller, and reciprocates in a direction as shown by an arrow when driven by a driving source, not shown. The discharge roller 2 is biased to the photoconductive member 1 by a depression device, not shown. The spacer 5*a* driven by the driving shaft 31 is controlled to slide the surface of the bearing 32 and is moved by a side plate, not shown, in a direction perpendicular to the photoconductive member 1. Now, an operation of an image forming apparatus of FIG. 8 employing such a discharge device is described. Since devices other than the discharge device are the same to those described in FIG. 8, their explanations are omitted. To summarize, the operation is to change a gap in accordance with image resolution selection.

The image forming apparatus allows selections of modes of image qualities, such as high quality (i.e., high resolution), high speed (i.e., low resolution), etc. A job selected through an operational panel or an external driver, is controlled and executed by a control section to have a prescribed resolution. Specifically, a control section controls intensity and a time period for emitting and modulating a laser light "L" from a laser writing unit 11 so as to change a size of a latent image and a rotational speed of the photoconductive member. When a signal instructing selection of high resolution and outputting of an image is inputted to the control section, the driving source for the driving shaft 31 that drives the spacer 5*a* is controlled by the signal, and rotates the spacer 5*a* so as to form a image on the photoconductive member while controlling a gap length between the discharge roller 2 and the photoconductive member 1.

As mentioned above, when the high resolution is selected, variation in discharge voltage caused by gap length variation on the photoconductive member is decreased by broadening the gap length. Further, since an amount of toner adhesion increases during the high resolution, an amount of toner not being transferred onto a recording sheet and remaining on the photoconductive member relatively increases. As a result, a mount of toner conveyed to the discharge roller increases. However, since the gap length is increased, toner adhering to the discharge roller can be suppressed.

In contrast, when the low resolution is selected, a gap length can be decreased and thereby unevenness of density can be suppressed. By decreasing an application voltage to the discharge roller, an amount of ozone generated during discharge can be decreased.

The above-mentioned invention can be applied to a discharge device that discharges an image bearer of color image forming apparatus wherein a plurality (e.g. four) of developing devices are arranged around one image bearer.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A charging device, comprising:

a charging member configured to discharge a photoconductive member via a prescribed gap; and a voltage applying device configured to apply direct current voltage to the charging member, the prescribed gap satisfying a relationship $\Delta V \geqq I \cdot d$, wherein $\Delta V$ is a predetermined allowable difference in voltage on the photoconductive member which corresponds to a predetermined allowable density difference in image density on an output image, d (V/micrometer) is a rate of a voltage discharged on the photoconductive member in relation to an interval of the prescribed gap I (micrometer) between the charging member and the photoconductive member, and said difference in voltage on the photoconductive member is adjusted based on a resolution of the output image.

2. An image forming unit detachably attached to an image forming apparatus, comprising:

a photoconductive member;

a charging device as claimed in claim 1; and a writing device configured to write an image on the photoconductive member while forming a latent image on the photoconductive member.

3. The image forming unit as claimed in claim 2, wherein said image is written on the photoconductive member using a digital signal.

4. The imager forming unit as claimed in claim 2, further comprising a controller configured to change a distance between the charging member and the photoconductive member based on a resolution of the latent image.

5. The image forming unit as claimed in claim 4, wherein a resolution of an image is changed by changing a distance between the charging member and the photoconductive member.

6. The image forming unit as claimed in claim 5, wherein said charging member and the photoconductive member are integrated.

7. The image forming unit as claimed in claim 6, further comprising a contact type cleaning member contacting a surface of the photoconductive member and configured to clean the surface, wherein said contact type cleaning member and the charging device are integrally detached from the image forming apparatus.

8. The image formation unit as claimed in claim 6, wherein said photoconductive member includes a surface layer, said surface layer including one of amorphous silicone and a material with a dispersed filler.

9. The charging device according to claim 1, wherein said voltage applying device applies only direct current voltage to the charging member.

10. An image forming apparatus, comprising:

a photoconductive member;

a charging device configured to discharge the photoconductive member via a prescribed gap;

a voltage applying device configured to apply direct current voltage to the charging device; and a writing device configured to write an image on the photoconductive member while forming a latent image on the photoconductive member, the prescribed gap satisfying a relationship $\Delta V \geqq I \cdot d$, wherein $\Delta V$ is a predetermined allowable difference in voltage on the photoconductive member which corresponds to a predetermined allowable density difference in image density on an output image, d (V/micrometer) is a rate of a voltage discharged on the photoconductive member in relation to an interval of the prescribed gap I (micrometer) between the charging device and the photoconductive member, and said difference in voltage on the photoconductive member is adjusted based on a resolution of the output image.

11. The image forming apparatus according to claim 10, wherein said voltage applying device applies only direct current voltage to the charging device.

* * * * *